United States Patent [19]

Shibayama et al.

[11] 3,998,720

[45] Dec. 21, 1976

[54] APPARATUS FOR PREPARING INSULATION WIRE BY ELECTRODEPOSITION

[75] Inventors: Kyoichi Shibayama; Fumihiko Sato; Yoshizumi Fuji; all of Minamishimizu-Amagasaki, Japan

[73] Assignee: Mitsubishi Denki Kabushiki Kaisha, Tokyo, Japan

[22] Filed: Oct. 29, 1975

[21] Appl. No.: 626,779

[30] Foreign Application Priority Data

Oct. 29, 1974 Japan ..... 49-125065

[52] U.S. Cl. ..... 204/300 EC; 204/181

[51] Int. Cl.[2] ..... C25D 13/04; C25D 13/24

[58] Field of Search ..... 204/300, 299, 181, 180 R, 204/28, 35 R, 37 R

[56] References Cited

UNITED STATES PATENTS

| | | | |
|---|---|---|---|
| 2,820,752 | 1/1958 | Heller | 204/300 X |
| 3,501,391 | 3/1970 | Smith et al. | 204/300 X |
| 3,573,191 | 3/1971 | De Vittorio | 204/300 |
| 3,749,657 | 7/1973 | LeBras et al. | 204/181 |

*Primary Examiner*—John H. Mack
*Assistant Examiner*—A. C. Prescott
*Attorney, Agent, or Firm*—Oblon, Fisher, Spivak, McClelland & Maier

[57] ABSTRACT

An apparatus for preparing an insulation wire by an electrodeposition coating method having means for forming a resin layer on the surface of a conductive material by electrodeposition coating, means for applying a coagulant thereto and means for curing by heating, wherein means are further provided for recovering the coagulant vapor generated in the means for applying the coagulant and in the means for heating the material.

4 Claims, 3 Drawing Figures

APPARATUS FOR PREPARING INSULATION WIRE BY ELECTRODEPOSITION

BACKGROUND OF THE INVENTION

1. Field of the Invention

The present invention relates generally to an apparatus for preparing an insulation wire by an electrodeposition coating method. More particularly, it relates to an apparatus for coating a conductive material with a resin layer by electrophoresis using a water dispersion synthetic resin varnish or a water soluble synthetic resin varnish and then recovering a coagulant applied thereto for insuring ready film-formation of the resin layer.

The purpose of the invention is to increase the economical advantage of the apparatus and to attain a non-pollutive operation.

2. Description of the Prior Art

Heretofore, according to known methods of electrodeposition coating of insulation on a conductive material, a varnish resin layer is formed on the conductive material by an electrophoresis using a water dispersion synthetic resin varnish or a water soluble resin varnish and then applying a coagulant as a film forming auxiliary agent, so that an insulation coated film is formed by heat-curing. In the heat-curing step of the known method, the coagulant adhered on or contained in the film is vaporized as a gas. However, recovery of the coagulant has not been practically conducted. There is only a proposal to remove it by a combustion in the presence of a catalyst.

These conventional methods are disadvantageous from the viewpoint of product cost, material savings of starting materials and because the operation is pollutive by nature.

Presently, 2–6 times of a coagulant to the total weight of the film resin has been lost in the electrodeposition of a water dispersion synthetic resin varnish in forming an insulation film, especially in the preparation of an electric wire. When the wire running speed is increased, loss of the coagulant is increased. Accordingly, it is disadvantageous from the economical viewpoint.

Also, since the varnish is cured at high temperature for forming the film, the coagulant is vaporized as a toxic gas, thereby causing air pollution such that the prior methods are disadvantageous from the viewpoint that they are polluting the atmosphere.

FIG. 1 is a block diagram of a conventional apparatus wherein the elongate conductive material is run in the direction indicated by the arrow line A through an annealing bath 2, a pretreatment bath 3, an electrodeposition bath 4, a part 5 for applying a coagulant, a preliminary drying and curing furnace 6 and a final curing furnace 7. In such conventional apparatus, the elongate wire-like conductive material 1, to which an insulation coating is to be applied, is first passed through the annealing furnace 2 to improve the processability thereof, and then, it is passed through the pretreatment bath 3 to clean the surface of the conductive material. It then is passed through the electrodeposition bath 4, filled with a water dispersion synthetic resin varnish or a water soluble synthetic resin varnish, to electrodeposit a resin layer and then through the part 5 for applying a gaseous coagulant thereto. Then, it is passed through the preliminary drying furnace 6 to remove most of the volatile materials by heating, whereupon it is passed through the final drying and curing furnace 7 to complete the insulation film.

In this type apparatus, the coagulant is lost by vaporizing at the part 5 for applying the coagulant and in the preliminary drying furnace 6, whereby the economical advantage is lost and the pollutive characteristics of the operation is adversely affected.

SUMMARY OF THE INVENTION

Accordingly, it is an object of the present invention to provide an apparatus wherein a solvent applied for easily forming a film of the coated resin layer by electrodeposition is recovered substantially without loss and is recycled to decrease the cost of the product, to provide a savings of materials and further to attain a non-pollutive operation.

The foregoing object of the present invention, and others as well, are attained through the provision of apparatus for preparing an insulation wire by an electrodeposition coating method to form a resin layer on a surface of a conductive material and application of a coagulant to the resin layer and heat curing the resin layer, which comprises means for recovering a vapor of the coagulant generated in the application of the coagulant and in the heat-curing, whereby the vapor of the coagulant is substantially recovered, so that loss of the coagulant is decreased, which in turn decreases the cost of the product, provides a savings of material and attains a non-polluting operation.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference numerals designate like or corresponding parts throughout the several views, and wherein.

DETAILED DESCRIPTION OF THE PREFERRED EMBODIMENTS

Figure 1:
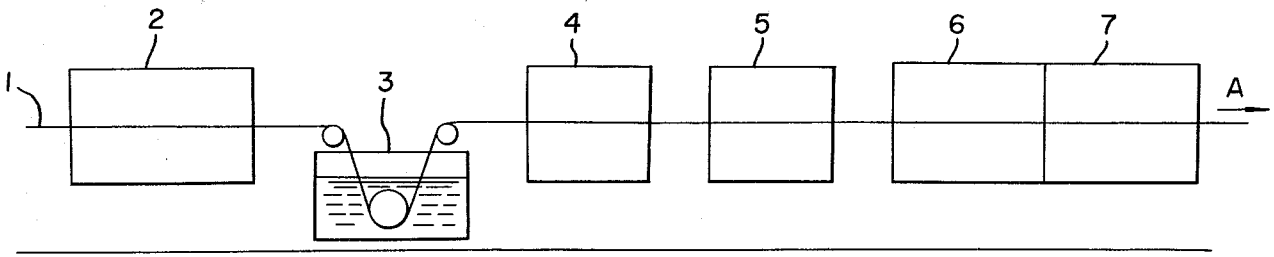
FIG. 1 is a block diagram of a conventional apparatus for preparing an insulation wire using a water dispersion synthetic resin varnish.
Figure 2:
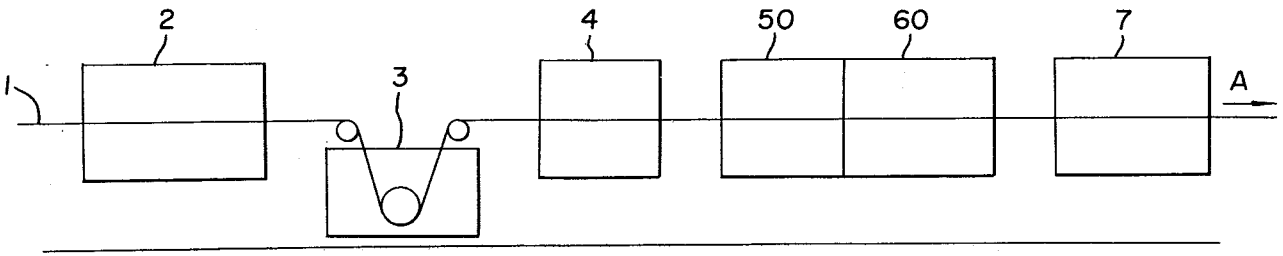
FIG. 2 is a block diagram of one embodiment of an apparatus according to the invention.

Referring again to the drawings, and particularly to FIG. 2, there is shown a block diagram of one embodiment of the apparatus of the present invention, wherein a device 50 is provided for applying a coagulant, such device having a recovery part, and a preliminary drying device 60 is arranged on its other side, the device 60 also having a recovery part. All of the other parts are the same as those shown in the conventional apparatus illustrated in FIG. 1.

Figure 3:
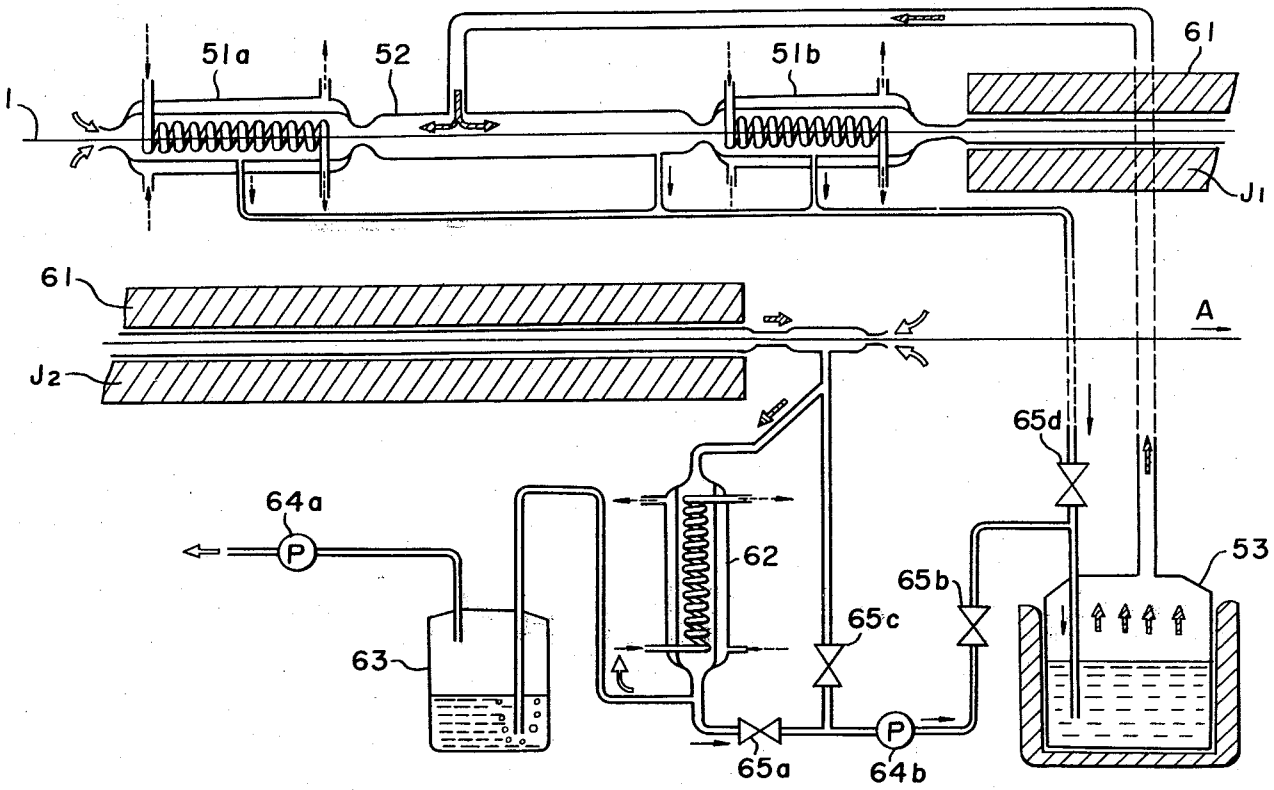
FIG. 3 is a schematic view of a coagulant recovering mechanism used in the apparatus of FIG. 2.

In FIG. 3, a schematic illustration of the device 50 for applying the coagulant and the preliminary drying device 60, characterizing the present invention, for coating a longitudinal conductive material 1 with a resin by an electrodeposition of a water dispersion synthetic resin varnish or a water soluble synthetic resin varnish, includes condensers 51*a*, 51*b*, a tube 52 therebetween for applying a coagulant to the condensers, and a coagulant evaporator 53. The main part of the device for applying the coagulant 50 is formed by the condensers 51*a*, 51*b*, the tube 52, and the evaporator 53. The Best Available Copy Best Available Copy reference numeral 61 designates the preliminary drying furnace of this invention, which includes a condenser 62, a gas washing bath 63 and pumps 64*a* and 64*b*. The reference numerals 65*a*, 65*b*, 65*c* and 65*d* designate cocks for regulating flow within the preliminary drying furnace. The shaded arrow lines show the movement of the coagulant vapor and the open arrow lines, having no shade, show a discharge gas from which the coagulant is recovered. The true arrow lines show flow of the liquified coagulant and the broken arrow lines show flow of the cooling water. The conductive material coated with the resin film by the electrodeposition is treated with the coagulant in the tube 52 for applying the coagulant.

Excess coagulant is condensed in the condensers 51*a*, 51*b*, disposed at opposing ends of the tube 52, to return the coagulant vapor to the coagulant evaporator 53 without discharging it. The conductive material 1 is further passed through the preliminary drying furnace 61 to evaporate most of the coagulant carried with the electrodeposited film.

Air containing the vaporized coagulant is aspirated by the pump 64*a* to pass through the condenser 62, to condense it. The coagulant is returned to the evaportator 53 by the pump 64*b*. Discharged air containing a small amount of the coagulant is passed through a water in the gas washing bath 63, wherein the hydrophilic coagulant is substantially trapped, and the discharged air is discharged as clean air. In a closed recycling system, the coagulant is repeatedly used without loss.

In accordance with the apparatus of the present invention, therefore, the coagulant recovery coefficient (coagulant returned to the coagulant evaporator / coagulant fed to the tube for applying coagulant) is higher than 97%. The effect of the apparatus of the invention will thus be illustrated by references of the conventional apparatus and examples.

REFERENCE 1

In a reactor, 45 parts by weight of styrene, 45 parts by weight of methyl methacrylate, 5 parts by weight of glycidyl methacrylate, 5 parts by weight of methacrylate, 200 parts by weight of a deionized water, 2 parts by weight of sodium laurylsulfate, 0.1 parts by weight of potassium persulfate and 0.033 part by weight of sodium bisulfite were charged, and the mixture was stirred for 30 minutes under a nitrogen gas flow, and was stirred at 50°–60° C for 4 hours to cause a reaction.

A water dispersion synthetic resin varnish was obtained. The water dispersion synthetic resin varnish was filled in an electrodeposition bath having a length of 50 cm.

A bare copper wire having a diameter of 0.3 mm was run at 18 m/min., while applying DC voltage of 2 between the wire and an electrode, and then was passed through the coagulant dipping bath having a length of 30 cm. to dip it in N,N-dimethylformamide (DMF) for 1.2 seconds. Then it was heated for curing purposes. A good insulation wire having a thickness of film of 25$\mu$ was obtained. However, a loss of DMF drawn out was about 3 times the coated resin weight.

REFERENCE 2

The bare copper wire was run at 18 m/min, while applying DC voltage of 2.4 by using the varnish and the apparatus of Reference 1, and then was passed through an atmosphere of DMF gas for 2 seconds to heat and cure it. A good insulation wire having a thickness of film of 25$\mu$ was obtained. However, a loss of DMF drawn out was about 2.5 times the coated resin weight.

REFERENCE 3

A water dispersion synthetic resin varnish was prepared by reacting 54 parts by weight of acrylonitrile, 27 parts by weight of styrene, 9 parts by weight of ethylacrylate, 5 parts by weight of methacrylic acid and 5 parts by weight of glycidyl methacrylate, in accordance with the process of Reference 1. The bare copper wire was run at 23 m/min., while applying DC voltage of 3, by using the varnish and the apparatus of Reference 1, and then was passed through a DMF bath for 1 second and heated to cure it. A good insulation wire having a thickness of film 26$\mu$ was obtained. However, a loss of DMF drawn out was about 4 times the coated resin weight.

EXAMPLE 1

The bare copper wire was run at 24 m/min., while applying DC voltage of 3.2, by using the varnish of Reference 1 and the apparatus of FIG. 2. The copper wire then was passed through an atmosphere of DMF gas for 1.5 seconds, and was heated to cure it. A good insulation wire having a thickness of 26$\mu$ was obtained. A loss of DMF drawn out was 0.2 times the coated resin weight, which was under 1/10 comparing the same with that of Reference 1.

EXAMPLE 2

The bare copper wire was run at 16 m/min., while applying DC voltage of 2.0, by using the varnish of Reference 3 and the apparatus of FIG. 2, and then passed through an atmosphere of DMF gas for 1.5 seconds. Then, it was heated to cure it. A good insulation wire having a thickness of 23$\mu$ was obtained. A loss of DMF drawn out was 0.2 times the coated resin, which was under 1/10 comparing the same with that of Reference 3.

The characteristics of the insulation wires prepared by the processes of References 1, 2 and 3 and Examples 1 and 2 will now be illustrated in the following table.

TABLE

| | Reference 1 | Reference 2 | Reference 3 | Example 1 | Example 2 |
|---|---|---|---|---|---|
| Diameter (mm) | 0.3 $\phi$ | 0.3 $\phi$ | 0.3 $\phi$ | 0.3 $\phi$ | 0.3 $\phi$ |
| Thickness of film ($\mu$) | 25 | 25 | 26 | 26 | 23 |
| Appearance | smooth gloss | smooth gloss | smooth gloss | smooth gloss | smooth gloss |
| Pin holes (counts/5m) | 0 | 0 | 0 | 0 | 0 |
| Breakdown voltage (KV) (two ply) | 9.3 | 8.3 | 9.1 | 8.8 | 8.4 |

TABLE-continued

| | Reference 1 | Reference 2 | Reference 3 | Example 1 | Example 2 |
|---|---|---|---|---|---|
| Kink | good | good | good | good | good |
| Winding property | good for 1 time of diameter | good for 1 time of diameter | good for 1 time of diameter | good for 1 time of diameter | good for 1 time of diameter |
| Abrasion resistance JIS (times) | 47 | 39 | 41 | 45 | 43 |
| Heat shock (180° C: 1hr.) | good for 1 time of diameter | good for 1 time of diameter | good for 1 time of diameter | good for 1 time of diameter | good for 1 time of diameter |
| Ratio of DMF drawn out to coated resin | 3.1 | 2.5 | 3.8 | 0.23 | 0.22 |

As is clear from Table 1, the characteristics of the insulation wires prepared by the apparatus according to the present invention are not inferior to those of the products of References 1, 2 and 3.

In FIG. 3, a method of applying a liquid coagulant is not shown. However, the apparatus of the invention can be used by replacing the tube for applying coagulant to a coagulant bath. The varnishes for electrodeposition used in the invention also are not limited to the varnishes specifically disclosed, and can be conventional varnishes for electrodeposition. Further, the coagulants used in the invention can be hydrophilic ones having a boiling point which is higher than that of water. It is especially preferable to use N,N-dimethylformamide, ethylcellosolve, buthylcellosolve, N-methyl-2-pyrolidone, etc.

The present invention thus provides apparatus comprising means for forming a resin layer on the surface of conductive material by an electrodeposition coating method and applying a hydrophilic coagulant to the resin layer and heating to cure it. It further provides means for recovering the coagulant as a liquid by aspirating and cooling a coagulant vapor generated in the part for applying the coagulant and the part for heating to cure it and means for removing the residual coagulant vapor by washing the discharged gas with water, from which the coagulant is recovered. A loss of the coagulant can be remarkably decreased and a non-pollutive operation is thus attained having remarkable effects in practical operation, when compared with that of the conventional apparatus.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. In an apparatus for preparing an insulation wire by an electrodeposition coating method which comprises:

means for forming a resin layer on the surface of a conductive material by an electrodeposition coating method;

means for applying a coagulant to the resin layer; and means for heating to cure it, the improvement which comprises means for recovering the coagulant vapor generated in the part for applying the coagulant and the part for heating to cure it.

2. An apparatus according to claim 1, wherein the means for recovering the coagulant vapor comprises an aspirating device.

3. An apparatus according to claim 1, wherein the means for recovering the coagulant vapor comprises a liquifying device.

4. An apparatus according to claim 1, which further comprises:

means for washing a discharged gas, after the recovery step, with water to remove a residual coagulant in the discharged gas.

* * * * *